US006005454A

United States Patent [19]

Kim

[11] Patent Number: 6,005,454

[45] Date of Patent: Dec. 21, 1999

[54] RADIO FREQUENCY POWER DIVIDER/ COMBINER CIRCUIT HAVING CONDUCTIVE LINES AND LUMPED CIRCUITS

[75] Inventor: Cheol-Hoo Kim, Seongnam, Rep. of Korea

[73] Assignee: Samsung Electronics Co., Ltd, Rep. of Korea

[21] Appl. No.: 08/907,791

[22] Filed: Aug. 8, 1997

[30] Foreign Application Priority Data

Aug. 8, 1996 [KR] Rep. of Korea ..... 96-33066

[51] Int. Cl.[6] ..... H01P 5/12

[52] U.S. Cl. ..... 333/128; 333/136

[58] Field of Search ..... 333/125, 127, 333/128, 136

[56] References Cited

U.S. PATENT DOCUMENTS

| | | | |
|---|---|---|---|
| 4,901,042 | 2/1990 | Terakawa et al. | 333/128 X |
| 5,126,704 | 6/1992 | Dittmer et al. | 333/125 |
| 5,489,880 | 2/1996 | Swarup | 333/128 |

FOREIGN PATENT DOCUMENTS

| | | | |
|---|---|---|---|
| 5037212 | 2/1993 | Japan | 333/127 |

OTHER PUBLICATIONS

Beckwith, W., et al; "Wideband width Monolihtic Power Dividers"; *Microwave Journal* ; Feb. 1989; pp. 155–157, 160.

Webb, Richard, C; "Power Divider/Combiners: Small Size, Big Specs"; Microwaves Nov. 1981; pp. 67–69, 72, 73.

*Primary Examiner*—Benny Lee

*Attorney, Agent, or Firm*—Dilworth & Barrese

[57] ABSTRACT

A radio frequency (RF) power divider/combiner circuit prevents an unbalance in current consumption according to a variation of the load, and reduces size of a power amplifier when employed therein. In an exemplary embodiment, the RF power divider/combiner circuit includes an input terminal, first and second output terminals, a first microstrip line connected to the input terminal and a second microstrip line vertically connected to the first microstrip line. A first capacitor is connected between a middle of the second microstrip line and ground. A first inductor has a first end connected to an end of the second microstrip line, a second inductor has an end connected to another end of the second microstrip line, and a second capacitor is connected between a second end of the first inductor and a second end of the second inductor. A third microstrip line is connected between the second end of the first inductor and the first output terminal, a fourth micro-strip line is connected between the second end of the second inductor and the second output terminal, and a resistor is connected in parallel with the second capacitor.

13 Claims, 3 Drawing Sheets

RADIO FREQUENCY POWER DIVIDER/ COMBINER CIRCUIT HAVING CONDUCTIVE LINES AND LUMPED CIRCUITS

BACKGROUND OF THE INVENTION

1. Field of the Invention

The present invention relates to a radio frequency power divider/combiner circuit, and more particularly to a radio frequency power divider/combiner circuit realized by using a microstrip line and lumped elements.

2. Description of the Related Art

In a conventional radio communication system, a power divider/combiner circuit (i.e., divider or combiner circuit) is generally used in a radio frequency (RF) power amplifier. Typically both a divider and a combiner are used—the divider divides an input signal into two or more divided signals, where each divided signal is applied to the input of a separate RF power transistor for amplification; and the combiner combines the output power of the power transistors. Such a power divider/combiner circuit is realized by using a micro-strip line, or a 3 dB hybrid coupler.

The power divider/combiner circuit which is realized by printing a transmission line (e.g., microstrip line) on a substrate, is designed to convert impedance by using a $\lambda/4$ line (where $\lambda$ is wavelength). In this case, input and output terminals of a power divider are respectively composed of 50Ω lines, and the $\lambda/4$ line is designed as a 70.7 Ω transmission line to achieve impedance matching. An example of this type of power divider is a "Wilkinson" type power divider.

It is known that the electrical length of a transmission line is determined based on a functional relation of the substrate permittivity and the operating frequency. That is, the physical length of a $\lambda/4$ transmission line needs to be longer for a relatively lower substrate permittivity and operating frequency. Therefore, it is difficult to realize the $\lambda/4$ line within a limited space (substrate) in an ultra high frequency (UHF) band. If the power divider/combiner is realized at UHF by using a $\lambda/4$ line such as in the Wilkinson divider, the power amplifier becomes too large in size for certain applications.

FIG. 1 illustrates a power amplifier which is realized by using a 3 dB hybrid coupler (or a 90° hybrid coupler). In the drawing, an RF signal input from an input terminal INPUT is applied to a hybrid input circuit 110. A resistor R having a resistance of 50 ohms is connected between input terminal ISO and the hybrid input circuit 110. The signals at output terminals, points A and B, of the hybrid input circuit 110 have equal RF power and a 90° phase difference. These signals are inputted to input matching circuits 112A and 112B which provide output signals to transistors 114A and 114B, respectively, which in turn provide output signals to output matching circuits 116A and 116B. In the power amplifier shown in FIG. 1, the current consumption of transistors 114A and 114B becomes different from each other, according to a characteristic, i.e., a return loss of the load. The different current consumption may cause serious damage to one of the transistors having the higher current consumption. As a result, the power amplifier will not operate or will generate decreased output power at terminal OUTPUT of hybrid output circuit 120. A resistor R having a resistance of 50 ohms is connected between the hybrid output circuit 120 and output terminal ISO.

It can be appreciated from the Smith chart shown in FIG. 2 that the current consumption varies according to the characteristic of the load. For instance, consider an impedance locus 202 with an output power being lower by about 1 dB than output power at an optimal point 201 at which the maximum power of the power amplifier is generated, in light of its characteristic. Here, if it is assumed that a reflection coefficient of the output load is a constant, i.e., k, which is generally derived by taking into consideration the resistivity of the load, i.e., $\rho_L$, the reflection coefficient looking into a point A of FIG. 1, i.e., ΓA, is represented by ΓA=k+θ, where θ is the phase of the signal inputted into point A, and the reflection coefficient looking into a point B, i.e., ΓB, is represented by ΓB=k+θ+180°. For example, if the current has a relationship of I2<I1=I3<I4, where points 1, 2, 3, and 4 represent points on the impedance locus 202 corresponding to the current values I1, I2, I3 and I4, respectively, which show the variation of current consumption as a function of the load, as shown in FIG. 2, the reflection coefficient ΓA corresponds to a position (4) and the reflection coefficient ΓB corresponds to a position (2). As a result, the transistor 114A (see FIG. 1) has the minimum current consumption and the transistor 114B (see FIG. 1) has the maximum current consumption, thereby resulting in the maximum current consumption difference between the two transistors. Then, a junction temperature (hot spot) of the transistor 114B increases, which results in serious damage to the transistor 114B.

As described above, if the power amplifier is realized in microstrip line, the power amplifier increases in size undesirably at lower operating frequencies such as the UHF band. Further, if the power amplifier is realized by using the 3 dB hybrid coupler, the outputs and the current consumption of the transistors 114A and 114B of the power amplifier vary according to the load characteristic (i.e., the reflection coefficient).

SUMMARY OF THE INVENTION

It is therefore an object of the present invention to provide a physically small power divider/combiner circuit for use in a power amplifier, which is capable of reducing size of the power amplifier as compared to prior art amplifiers.

It is another object of the present invention to provide a power divider/combiner circuit capable of preventing an unbalance of current consumption with a variation in transistor loads.

In an exemplary embodiment of the present invention, a radio frequency power divider/combiner circuit includes first, second and third microstrip lines, and lumped elements distributed among the microstrip lines, where the lumped elements serve as a quarter wave transmission line. Advantageously, the lumped elements occupy less physical space than an actual quarter wave transmission line, such that the overall size of the circuit is reduced as compared to the prior art.

In the exemplary embodiment a first microstrip line is connected to an input terminal, a second microstrip line is vertically connected to the first microstrip line, and a first capacitor is connected between a middle of the second microstrip line and a ground. A first inductor has a first end connected to an end of the second microstrip line. A second inductor has a first end connected to another end of the second microstrip line, a second capacitor is connected between a second end of the first inductor and a second end of the second inductor, and a third microstrip line is connected between the second end of the first inductor and the first output terminal. A fourth microstrip line is connected between the second end of the second inductor and the second output terminal, and a resistor is connected in parallel with the second capacitor.

BRIEF DESCRIPTION OF THE DRAWINGS

The above and other objects, features and advantages of the present invention will become more apparent in the light of the following detailed description of an exemplary embodiment thereof taken with the attached drawings in which.

DETAILED DESCRIPTION OF THE PREFERRED EMBODIMENT

Figure 1:
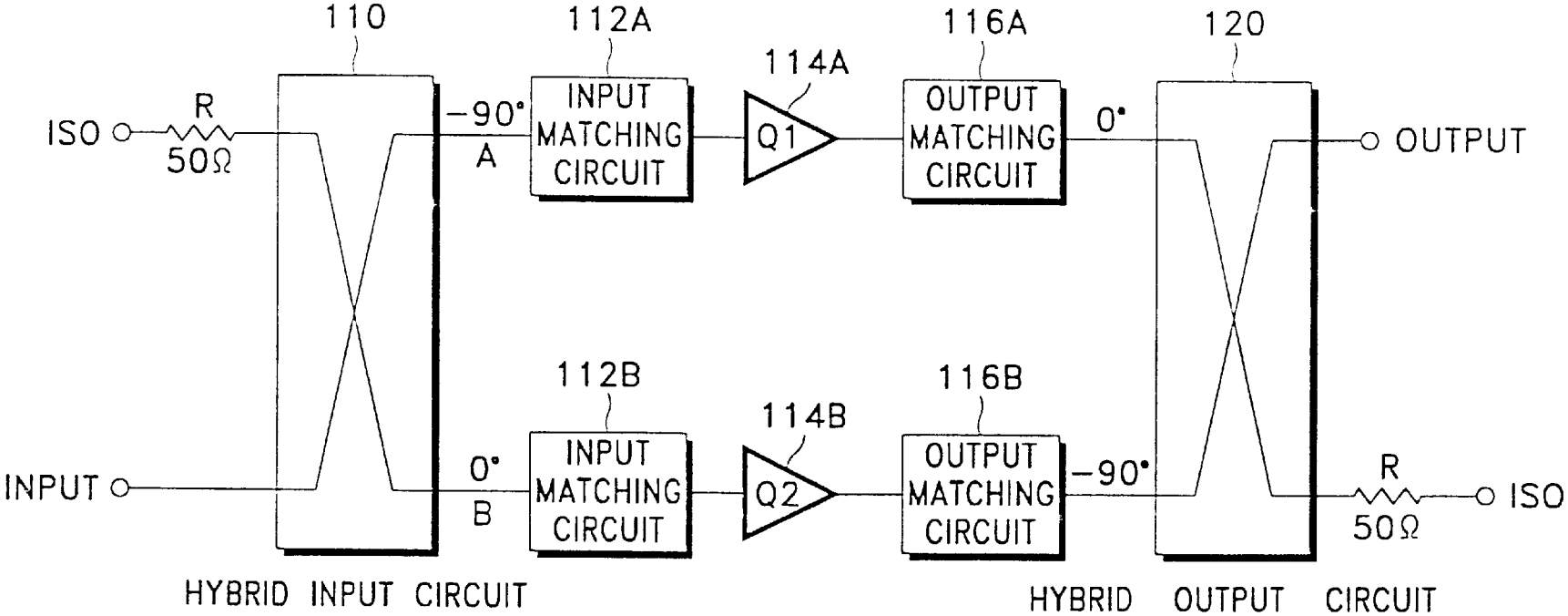
FIG. 1 is diagram of a radio frequency power amplifier realized by using a 3 dB hybrid coupler according to the prior art.
Figure 2:
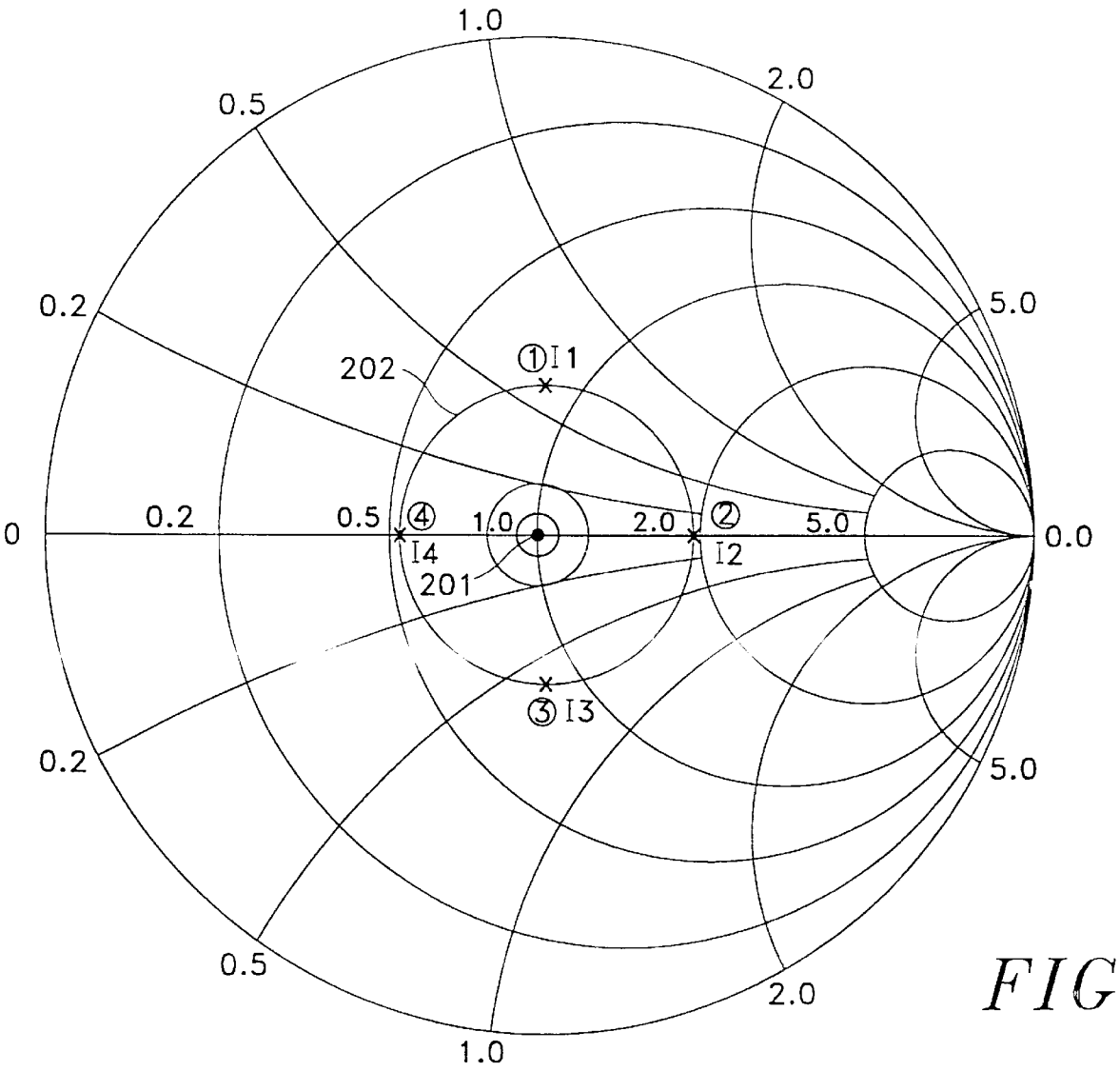
FIG. 2 is a Smith chart for explaining that the current consumption of a radio frequency power amplifier varies according to a load characteristic.

A preferred embodiment of the present invention will be described in detail hereinbelow with reference to the attached drawings, in which like reference numerals represent like elements. Further, it should be clearly understood by those skilled in the art that many specifics such as the detailed circuit elements are shown only by way of example to bring a better understanding of the present invention, and that the present invention may be embodied without these specifics. The terms used in the specification are defined in due consideration of the functions of the invention and are replaceable according to a usual practice or an intention of the user or chip designer. Preferably, the terms shall be defined based on the contents described throughout the specification.

Figure 3:
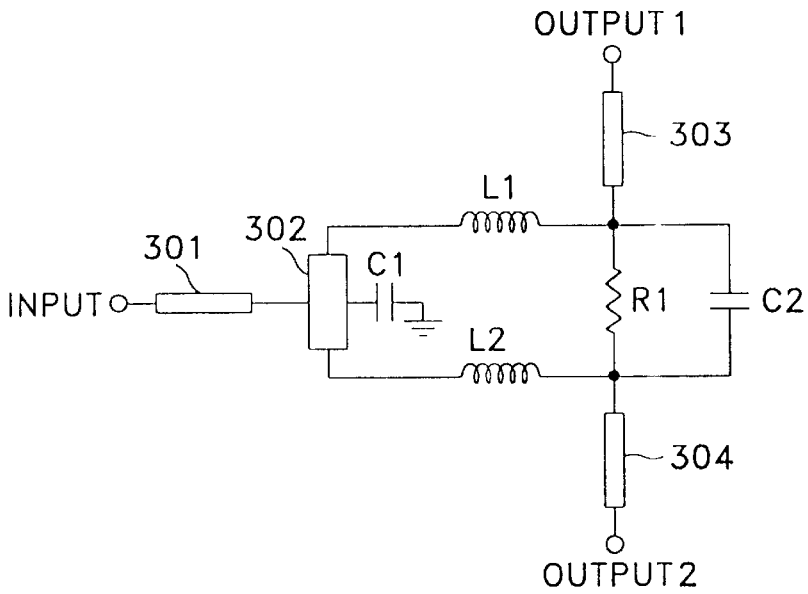
FIG. 3 is a circuit diagram of a radio frequency power divider/combiner circuit according to a preferred embodiment of the present invention.

Referring to FIG. 3, there is illustrated a radio frequency power divider/combiner circuit according to the present invention, in which the power divider/combiner circuit is composed of first to fourth microstrip lines 301, 302, 303, and 304, and a hybrid circuit comprised of inductors L1, L2, capacitors C1, C2, and resistor R1. Specifically, the first microstrip line 301 is connected to an input terminal INPUT, and the second microstrip line 302 is vertically connected to the first microstrip line 301. When the circuit of FIG. 3 is used as a divider, input RF power is applied to the INPUT terminal and divided output power is provided at each of output terminals OUTPUT 1 and OUTPUT 2. The signal output at each output terminal may be applied, e.g., to the input of a respective power transistor. When the circuit of FIG. 3 is used as a combiner, input signals, e.g., each originating from the output of a respective power transistor, are applied to the OUTPUT 1 and OUTPUT 2 terminals, and a combined output signal is provided at the INPUT terminal.

A first capacitor C1 is connected between a middle of the second microstrip line 302 and ground. A first inductor L1 has a first end connected to an end of the second microstrip line 302, and a second inductor L2 has a first end connected to another end of the second microstrip line 302. A second capacitor C2 is connected between a second end of inductor L1 and a second end of inductor L2. A third microstrip line 303 is connected between the second end of inductor L1 and output terminal OUTPUT 1. A fourth microstrip line 304 is connected between the second end of inductor L2 and the output terminal OUTPUT 2. A resistor R1 is connected in parallel with the second capacitor C2.

First and second inductors L1 and L2 are preferably air-core coils, and the first and second capacitors C1 and C2 are high frequency chip capacitors. The hybrid circuit comprised of the inductors L1 and L2, the capacitors C1 and C2, and the resistor R1, serves as a $\lambda/4$ transmission line on a substrate. Each of the first to fourth microstrip lines 301, 302, 303, and 304 may be formed as a 50 Ω transmission line on a TEFLON®, i.e., polytetrafluorethylene, substrate over a ground plate. An exemplary thickness for the substrate is about 2.2 mm, and an exemplary permittivity of the TEFLON®or other synthetic resinous fluorine substrate is 2.5. The resistor R1 is an isolation resistor of, e.g., 100W/100 Ω rating for isolating the first output terminal OUTPUT 1 from the second output terminal OUTPUT 2. The first and second inductors L1 and L2 have the same inductance, and are coupled to the chip capacitors C1 and C2 to divide the input power from the input terminal INPUT (when the circuit is used as a divider), or to combine the RF power applied to the output terminals (when the circuit is used as a combiner).

Figure 4:
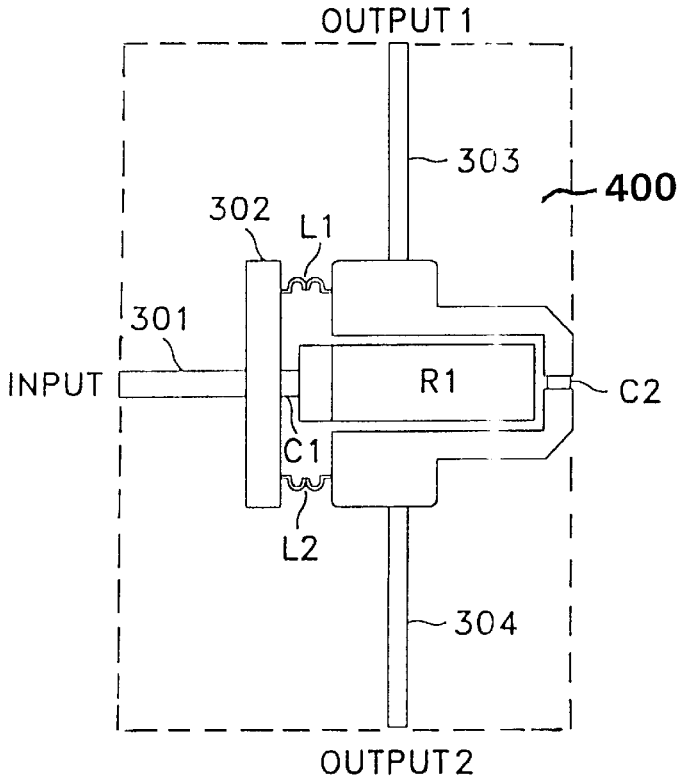
FIG. 4 shows an actual layout of the radio frequency power divider/combiner circuit of FIG. 3 arranged on a substrate.

Referring to FIG. 4, there is illustrated an actual layout of the RF power divider/combiner circuit of FIG. 3 arranged on a substrate. The elements of FIG. 4 correspond to the same elements described above with reference to FIG. 3, and hence will not be further described in detail. With reference to the drawing, since the RF power divider/combiner c cording to the present invention has a symmetrical structure, the input impedances as seen looking into both of terminals OUTPUT 1 and OUTPUT 2 (i.e., output terminals when the circuit is used as a divider, or input terminals when the circuit is used as a combiner) are the same with respect to each other, even with variation in the load (reflection coefficient variation, phase difference) on the output side. In prior art divider/combiner circuits, the difference between the current consumption of the transistors 114A (see FIG. 1) and 114B depends on the extent of the mismatching of the output matching circuit. However, in the combiner circuit of the present invention, when the load varies, the influence according to the load variation is applied to both of the transistors 114A and 114B, so that the current balance may be maintained.

As described in the foregoing, the transmission line is realized by using the lumped elements, so that the power amplifier can be reduced in size. Further, since the air-core coils and the chip capacitors serve as a low pass filter, the power divider/combiner circuit of the invention can remove the higher harmonics and the unnecessary frequency components. Therefore, compared with the 3 dB hybrid coupler, the power divider/combiner circuit of the present invention has a low pass filtering effect of about 20–30 dB. Further, being an in-phase divider/combiner circuit, the power divider/combiner circuit of the invention has a symmetrical structure. Therefore, the unbalance problem according to the variation of the load can be removed, so that the power amplifier may have an improved reliability.

Although a preferred embodiment of the present invention has been described in detail hereinabove, it should be clearly understood that many variations and/or modifications of the basic inventive concepts herein taught which may appear to those skilled in the art will still fall within the spirit and scope of the present invention as defined in the appended claims.

What is claimed is:

1. A radio frequency power divider/combiner circuit, comprising:

an input terminal;

first and second output terminals;

first, second, third and fourth microstrip lines, a first end of said first microstrip line being connected to said input terminal, an end of said second microstrip line being connected to said first output terminal, an end of said third microstrip line being connected to said second output terminal, and an end of said first microstrip line being connected to a midpoint of said fourth microstrip line; and lumped elements comprising:

a first coil connected between an end of said fourth microstrip line and another end of said second microstrip line;

a second coil connected between said another end of said fourth microstrip line and another end of said third microstrip line;

a first capacitor connected between said midpoint of said fourth microstrip line and a ground; and a second capacitor connected between said another end of said second microstrip line and said another end of said third microstrip line.

2. A radio frequency of power divider/combiner circuit according to claim 1, further comprising a resistor connected in parallel with said second capacitor.

3. A radio frequency power divider/combiner circuit, comprising:

an input terminal;

first and second output terminals;

a first microstrip line connected to said input terminal;

a second microstrip line connected to said first microstrip line at about a midpoint of said second microstrip line in substantially orthogonal alignment with said first microstrip line;

a first capacitor connected between said midpoint of said second microstrip line and a ground;

a first inductor having a first end connected to an end of said second microstrip line;

a second inductor having a first end connected to another end of said second microstrip line;

a second capacitor connected between a second end of said first inductor and a second end of said second inductor;

a third microstrip line connected between said second end of said first inductor and said first output terminal;

a fourth microstrip line connected between said second end of said second inductor and said second output terminal; and a resistor connected in parallel with said second capacitor.

4. A radio frequency power divider/combiner circuit according to claim 3 wherein said resistor is an isolation resistor having a rating of 100W/100Ω for isolating the first output terminal from the second output terminal.

5. A radio frequency power divider/combiner circuit according to claim 3 wherein said first and second inductors are each air-core coils having equal inductance.

6. A radio frequency power divider/combiner circuit according to claim 3 wherein said first and second capacitors are each high frequency chip capacitors.

7. A radio frequency power divider/combiner circuit according to claim 3 wherein said first, second and third and fourth microstrip lines are each 50 ohm lines disposed on a substrate having a thickness of about 2.2mm.

8. A radio frequency power divider/combiner circuit according to claim 7, wherein said substrate is comprised of polytetrafluorethylene and has a permittivity of 2.5.

9. A symmetrical radio frequency (RF) circuit capable of dividing an input signal into two output signals, comprising:

an input terminal for receiving the input signal;

first and second output terminals, each of said output terminals for providing a respective one of the two output signals;

first, second, third and fourth conductive strips, an end of said first conductive strip being connected to said input terminal, a midpoint of said fourth conductive strip being connected to another end of said first conductive strip, an end of said second conductive strip being connected to said first output terminal, an end of said third conductive strip being connected to said second output terminal; and lumped elements connected among said first to fourth conductive strips, said lumped elements including at least a coil and at least a capacitor.

10. The circuit of claim 9 wherein said lumped elements comprise:

a first coil connected between an end of said fourth conductive strip and another end of said second conductive strip;

a second coil connected between said another end of said fourth conductive strip and another end of said third conductive strip;

a first capacitor connected between said midpoint of said fourth conductive strip and a ground; and a second capacitor connected between said another end of said second conductive strip and said another end of said third microstrip line.

11. The circuit of claim 10 wherein said first and second coils and said first and second capacitors each operate as a respective quarter wavelength transmission line on a substrate.

12. The RF circuit of claim 9 wherein each conductive strip is a respective conductor of a corresponding microstrip transmission line.

13. The RF circuit of calim 9 wherein the two output signals are provided with substantially equal power.

* * * * *